United States Patent [19]

Dabich

[11] Patent Number: 4,467,932

[45] Date of Patent: Aug. 28, 1984

[54] EASY LIFT PIT LID

[76] Inventor: Robert M. Dabich, 7212 Patterson Dr., Garden Grove, Calif. 92641

[21] Appl. No.: 538,187

[22] Filed: Oct. 3, 1983

[51] Int. Cl.[3] ..... B65D 25/24

[52] U.S. Cl. ..... 220/18; 220/334

[58] Field of Search ..... 220/18, 334, 335

[56] References Cited

U.S. PATENT DOCUMENTS

| | | | |
|---|---|---|---|
| 3,190,039 | 6/1965 | Carlson | 220/18 |
| 3,541,727 | 11/1970 | Carlson | 220/18 |
| 4,065,020 | 12/1977 | Carlson | 220/18 |

*Primary Examiner*—George T. Hall

*Attorney, Agent, or Firm*—Charles H. Thomas

[57] ABSTRACT

A servo power system is provided for the heavy lid of a pit designed for installation below the surface of an aircraft docking and refueling area. For one embodiment, a counterbalancing system is shown. The lid is mounted for rotation at the top of a pit wall about lid hinges lying along a horizontal axis. A counterweight is secured for rotation about a horizontal counterweight axis which is located below and parallel to the lid axis. Meshed gear sections on the lid and on the counterweight couple the lid and counterweight to move together in counter-rotation relative to each other. The weight of the lid is largely balanced by the weight of the counterweight, thereby facilitating opening and closing of the pit lid.

18 Claims, 5 Drawing Figures

EASY LIFT PIT LID

BACKGROUND OF THE INVENTION

1. Field of the Invention

The present invention relates to heavy lids for subsurface enclosures, and particularly for lids on pits designed for use in servicing aircraft, etc. at docking, loading and refueling terminals.

2. Description of the Prior Art

At modern aircraft terminals servicing of aircraft on the ground is frequently performed using prefabricated pits which are installed at aircraft docking, fueling and loading areas beneath the surface of the tarmac across which aircraft travel during docking and departure maneuvers. The pits are typically formed of fiberglass, steel or aluminum and are constructed as enclosures with surrounding walls, a floor, and an access lid at the top of the walls. The pits are installed below the surface of loading and refueling aprons at aircraft terminals, remote parking locations and maintenance bases.

The purpose of the pits is to allow ground support functions to be carried out from subsurface enclosures. These ground support functions include the provision of fuel, the provision of electricity to the aircraft while it is in the docking area, the provision of air for cooling the aircraft interior and pressurized air for starting the aircraft engines, and other aircraft support activities on the ground. The use of subsurface pits eliminates the need for mobile trucks, carts and other vehicles which are otherwise present in the loading area and which interfere with the arrival and departure of aircraft in the vicinity of a loading gate. The use of subsurface pits also allows the provision of fuel, power, cooling and pressurized air, and other supplies from a central location. The necessary fluid supplies and electrical power can be generated or stored with great efficiency at a central location, as contrasted with mobile generating or supply vehicles.

The pits located below the aircraft terminal area house valves, junction boxes, cooling air terminations and other terminal equipment used to service an aircraft that has been docked. Umbilical pipes and lines, otherwise housed within the pits, are withdrawn from the pits through hatches therein and coupled to the docked aircraft to supply it with fuel, air for cooling the aircraft interior, pressurized air for starting the engines, and electrical power.

The pits are constructed with hinged, disc-like hatches within a more expansive, generally rectangular lid. The hatches are ordinarily used to withdraw fueling lines and the like, and can be lifted using one hand. Both the hatches and lids must be constructed of heavy-duty aluminum or steel, or other material, as they must be able to withstand the weight of an aircraft as it rolls across the surface.

Conventional pit lids are far too heavy to be lifted manually, even though it is quite desirable to have access to the complete enclosure of the pit for servicing faulty equipment, freeing fouled lines, and for performing other maintenance and repair functions in the pit. Heretofore, it has been necessary to employ a motorized lift or other machine to raise the lid of a subsurface pit for this reason. Pits of the type described are constructed in various sizes, and lids having dimensions of four to eight feet by three to five feet are typical. Accordingly, a very large force is required to lift such a lid.

SUMMARY OF THE INVENTION

The present invention provides the lids of subsurface pits with servo power, as for instance, counterweights which allow lids of a very great weight to be lifted with only a small force. That is, a lid weighing many hundreds of pounds may be lifted with a force of only ten to twenty-five pounds, for example.

According to the invention, the counterweights are mounted in the pit so as to minimize any torsional force acting along the length of the lid axis. That is, the counterweight may be mounted on an arm projecting from a pit wall below the lid hinges and midway between the opposite longitudinal extremities of the lid axis. Alternatively, a plurality of counterweight arms may be employed and spaced from each other in axial separation along the counterweight axis preferably equidistant from the longitudinal center of the lid.

The counterweight arms are generally horizontal disposed when the lid is closed. The ends of the arms proximate to the lateral edges of the lid are mounted by counterweight hinges, typically by brackets on the pit wall proximate to the lid hinge axis.

Some means is necessary for coupling the lid and the counterweight or counterweights for movement in counter-rotation together. This coupling means may take the form of meshed gear sections or complete gears. One gear section may be secured to or integrally formed with a counterweight arm, and the other gear section may be secured to or integrally formed with the pit lid. The gear section which is joined to the counterweight arm rotates about the counterweight axis, while the gear section on the lid rotates with the lid about the lid hinge axis. Any convenient gear configuration, such as spur gears, herringbone or helical gears, and other conventional gearing arrangements, may be employed to lock the lid and counterweight or counterweights together for movement in counter-rotation relative to each other.

When the pit lid is closed, the counterweight arms are raised and extend in a generally horizontal disposition. A moment is created by the counterweights which, through the counter-rotational coupling, tends to aid in opening the lid. The moment of the lid about the lid hinges, on the other hand, opposes the moment created by the counterweight and tends to hold the lid shut. The balancing mechanism should be constructed so that the torsional moment created by the weight of the lid is slightly larger than that of the counterweight system, so that the lid will remain closed once it has been shut. However, due to the opposing moment of the counterweight, the lid can be easily opened by an individual of normal strength using only one hand.

In a preferred embodiment of the invention, the balancing system is adjustable. Some means is provided for adjusting the distance of the center of mass of the counterweights from the counterweight axis. This can be accomplished by constructing the counterweights as structures separable from the counterweight arms and positionable at selected locations along the counterweight arms. Some means for releaseably securing the weights relative to the arms is provided. Set screws, latches, bolts, or other simple mechanical mechanisms may be used to perform this function.

The coupling mechanism controls the motion of both the lid and the counterweights by moving the counterweights in arcuate movement at a fixed ration relative to the arcuate movement of the lid. It is frequently desirable to open the lid beyond an upright vertical disposition so that it resides in an obtuse angle relative to its closed position. This facilitates maneuvering bulky equipment or tools into the pit, and also facilitates the withdrawal of such materials from the pit. It is not particularly desirable for the counterweights to rotate beyond a position in which the counterweight arms extend vertically downward, however, as this requires the installation of cheek pockets or other recesses to allow passage of the counterweight arms through an obtuse angle. The construction of cheek pockets in a pit can be avoided by employing a motion controlling means in the coupling mechanism which moves the counterweights at a fixed fraction, less than unity, of the movement of the lid. Thus, while the lid is moved through an angle of perhaps 110 degrees in one direction of rotation, the counterweights are moved through an angle of perhaps 90 degrees in an opposite direction of rotation.

The control of motion to rotate the counterweights through a smaller angle than the lid can be achieved by constructing the gear section attached to the lid with a smaller pitch diameter than the counterweight gear section. The counterweight gear section will thus rotate through a smaller arc than a corresponding rotation of the lid gear section.

In other applications the use of cheek pockets in a prefabricated pit may not be undesirable. Accordingly, the pit can be constructed with such cheek pockets and the lid and counterweight gear sections can have the same pitch diameter.

One embodiment of the invention may be described with greater clarity and particularity by reference to the accompanying drawings.

DESCRIPTION OF THE EMBODIMENTS

Figure 1:
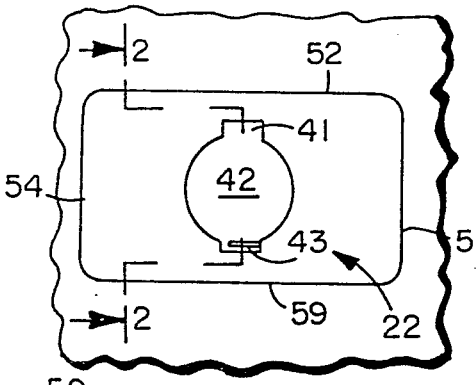
FIG. 1 is a top-plan view of the lid of a prefabricated pit employing a balancing mechanism according to the invention.
Figure 2:
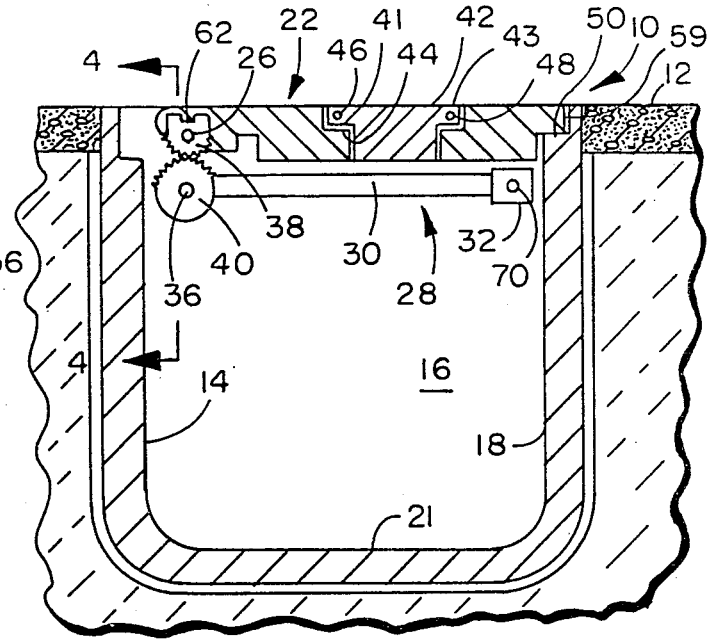
FIG. 2 is a sectional elevational view taken along the lines 2—2 of FIG. 1 and showing the lid in a closed position.

FIG. 2 illustrates a prefabricated pit 10 designed for installation below a tarmac surface 12 at an aircraft docking area. The pit 10 is formed of fiberglass and defines a subsurface chamber of generally rectangular configuration and having walls visible at 14, 16, 18 and 20, and a floor indicated at 21.

The pit 10 has a lid 22 which is rotatable about lid hinges 24 located at the top of the wall 14. One of the hinges 24 is depicted in FIG. 4. The hinges 24 define a horizontal lid axis indicated at 26 in FIGS. 2, 3, and 4.

Rotatable counterweight mechanisms 28, each having a radially extending arm 30 and a counterweight 32 mounted slideably thereon, are secured for rotation about counterweight hinges 34, depicted in FIG. 4. The counterweight hinges 34 also define a horizontal counterweight axis 36 which is located below and parallel to the lid axis 26. Coupling means in the form of counter-rotatable, meshed gear sections 38 and 40, rigidly join the counterweight mechanisms 28 to the lid 22 to move the counterweight mechanisms 28 below the level of the lid 22 and in counter-rotation relative thereto.

The lid 22 is a heavy steel or aluminum structure designed to withstand the weight of the tires of an aircraft traveling thereacross. The upper surface of the lid 22 includes ridges for enhancing traction thereto. At approximately the center of the lid 22 there is a smaller, generally disc-shaped hatch 42. The hatch 42 may have diametrically opposed flanges 41 and 43. The flanges 41 and 43 seat in corresponding recesses in the upper surface of the lid 22. The upper portion of the hatch 42 is of annular configuration defining a bearing ledge which seats on a corresponding annular, upwardly facing shoulder 44 recessed below the upper surface of the lid 22.

The hatch 42 is hinged to the lid 22 by means of a hatch axle 46, so that the hatch 42 can be opened to allow refueling lines, air ducts, electrical power supply cords, and the like to be withdrawn from the pit 10. The hatch 42 is releaseably secured shut by means of a sliding draw bolt latch 48.

An upwardly facing bearing shoulder 50 is defined about the perimeter of the pit 10 at the tops of the vertically disposed walls thereof. The bearing shoulder 50 supports all of the edges of the lid 22, except the hinged edge 52. The hinged edge 52 is rounded so as to provide clearance relative to the surrounding rim of the tops of the pit walls when the lid 22 is rotated upwardly about the lid axis 26.

In the embodiment of the invention illustrated in FIGS. 1–4, the two counterweight mechanisms are located proximate to and below the lateral edges 54 and 56 of the lid 22. The counterweight structures 28 are spaced in axial separation from each other along the counterweight axis 36 approximately equidistant from the longitudinal center of the lid 22. The center of mass of the lid 22 is located at its geometric center. The counterweight mechanisms 28 are thereby longitudinally positioned to balance torsional forces on the lid hinges 24. Such torsional forces are produced by the weight of the lid 22 and the weight of the counterweight mechanisms 28.

A pair of mounting brackets 58 project inwardly toward the cavity defined the pit 10 and upwardly toward the lid 22 from the wall 14. The mounting brackets 58 are of an L-shaped configuration and are located near the pit walls 16 and 20 at the top of the pit wall 14. The mounting brackets 58 each include an upwardly projecting leg with a horizontal aperture defined therethrough to receive a lid hinge axle 60, illustrated in FIG. 4. The lid hinge axle 60 lies along the lid axis 26 and passes through a downwardly disposed lid 62 at the lateral edges 54 and 56 of the lid 22. The lid axle 60 may be constructed in the form of a bolt which is threadably engaged in corresponding threads in an uppermost horizontal aperture in the interior of each pair of mounting brackets 58, as best depicted in FIG. 4.

The lid hinge axle bolt 60 passes through an aperture in the gear section 38. The gear section 38 does not define a complete gear, but rather gear teeth are disposed radially about an arc about 100 degrees facing downwardly toward the pit cavity when the lid 22 is closed and centered about the lid axis 26. The upwardly facing portion of the gear section 38 defines a pair of feet which seat in corresponding recesses on either side of a ridge 62 cast into the structure of the lid 22 and extending parallel to the edge 52 thereof. The axle bolt 60 passes through a horizontal aperture through the gear section 38 at the gear axis. The lid gear section 38 is thereby locked by means of the ridge 62 and the axle bolt 60 for movement with the lid 22. The gear section 38 could be integrally cast with the lid 22. However, by forming the gear section 38 as an insertable structure, the gear section 38 can be replaced, if necessary, without replacing the entire lid 22.

Another set of horizontal apertures are defined through the mounting brackets 58 below the apertures at the lid axis 26 along the horizontally disposed counterweight axis 36. A counterweight bolt 64 holds the counterweight gear section 40 between the mounting brackets 58, and the gear section 40 is rotatable about the counterweight gear axle bolt 64.

The counterweight gear section 40 may be a separate structure, or it may be integrally formed with the counterweight arm 30. The counterweight gear section 40, like the lid gear section 38, includes teeth over an arc of only about 100 degrees or more.

Figure 3:
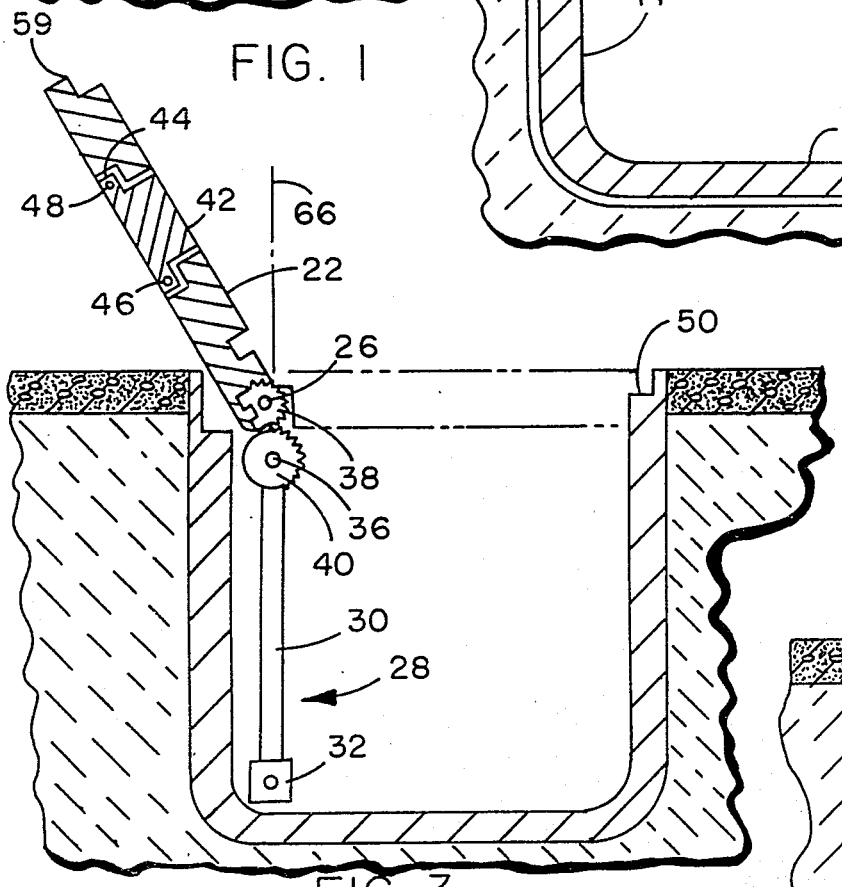
FIG. 3 is a sectional elevational view corresponding to FIG. 2 and showing the lid in the fully opened position.
Figure 4:
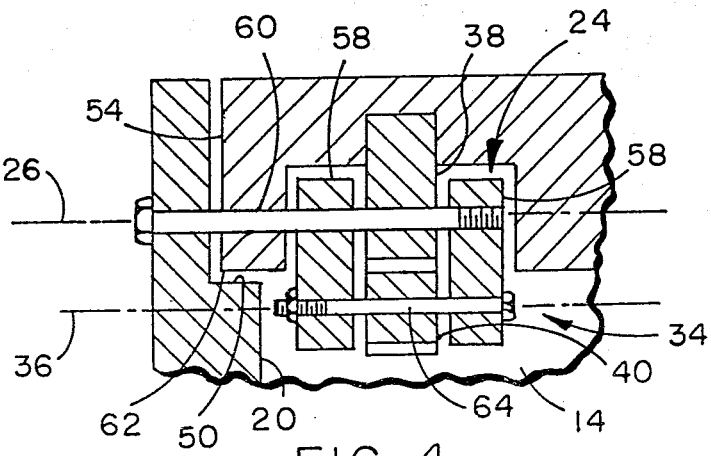
FIG. 4 is a sectional detail taken along the lines 4—4 in FIG. 2.

In the embodiment of FIGS. 1–4, the pitch diameter of the lid gear section 38 is smaller than the pitch diameter of the counterweight gear section 40. Thus, the counterweight gear section 40 will move the counterweight 32 in arcuate movement at a fixed fraction less than one relative to the arcuate movement of the lid 22. As illustrated in FIG. 2, the counterweight mechanisms 28 are located in a horizontal plane passing through the counterweight axis 36 when the lid 22 is closed. When the lid 22 is open, as depicted in FIG. 3, the gear section 40 allows the counterweight 32 to rotate downwardly through an arc of 90 degrees to a position vertically beneath the counterweight axis 36. Because the pitch diameter of the gear section 38 is smaller than that of the gear section 40, the lid 22 can be opened through an obtuse angle, passing over the lid axis 26. The movement of the counterweight 32 is thus limited to movement within the generally rectalinear confines of the pit 10 while the lid 22 is opened wide enough to allow bulky equipment or tools to be moved into and withdrawn from the pit 10.

Preferably, the weight and position of the counterweight 32 is adjusted so that approximately twenty pounds of lifting force are required to open the lid 22 from the closed position of FIG. 2. Up to approximately forty pounds of force in the opposite direction are required to close the lid from a position directly above the lid axis 26 in a vertical plane indicated at 66 in FIG. 3.

As the heavy lid 22 is lifted by a counterclockwise force from the closed position of FIG. 2, it is aided by the force of gravity acting on the counterweight 32. This is, the counterweight 32 tends to rotate the gear section 40 in a clockwise direction, as viewed in FIGS. 2 and 3. Although the weight of the counterweight 32 alone is insufficient to force the lid 22 open, with the addition of a slight upward force, preferably twenty pounds, the counterweight 32 will travel downwardly through an arc of approximately 90 degrees. The counterweight gear section 40 which is rigidly coupled thereto through the counterweight arm 30 also rotates through the same arc. The counterweight gear section 40 is coupled in meshed engagement with the lid gear section 38, and moves the lid gear section 38 in counterclockwise, counter-rotation to assist the lifting force in opening the lid 22. The lid 22 is rotatable about the lid axis 26 through an arc of approximately 110 degrees to the position of FIG. 3.

To close the lid 22, a clockwise force is exerted on the lid 22 at the edge 59 thereof. When the lid 22 is located vertically above the lid axis 26 in the plane 66, a force of up to approximately forty pounds is required to continue counterclockwise rotation of the lid 22 and the lid gear section 38. When the lid gear section 38 is rotated in a clockwise direction, the meshed engagement with the counterweight gear section 40 rotates the counterweight gear section 40 in a counterclockwise direction and lifts the counterweight 32 until it is returned to the position of FIG. 2 in which it lies in a horizontal plane passing through the counterweight axis 36.

The magnitude of force necessary to move the lid 22 in arcuate rotation can be adjusted by adjusting the disposition of the counterweight 32 along the counterweight arm 30. That is, the counterweight 32 is slideably engaged with the counterweight arm 30 and is releasably secured thereto by a set screw 70 or similar means. FIGS. 2 and 3 illustrate the counterweight 32 as being located at the radial extremity of the counterweight arm 30. However, the counterweight 32 can slide radially toward the counterweight axis 36 along the counterweight arm 30 when the set screw 70 is loosened. As the counterweight 32 is moved toward the counterweight axis 36 along the counterweight arm 30, the force necessary to move the lid 22 is increased, since a smaller portion of the weight of the lid 22 is balanced by the counterweight 32.

It is therefore possible for the counterweight mechanism 28 to be adjusted to produce any desired moment of force opposing the weight of the lid 22 by adjusting the distance of the center of mass of the counterweight 32 from the counterweight axis 36. The moment produced by the counterweight 32 should never be quite as great as the moment resulting from the weight of the lid 22, since the lid 22 would then open by itself unless restrained.

Figure 5:
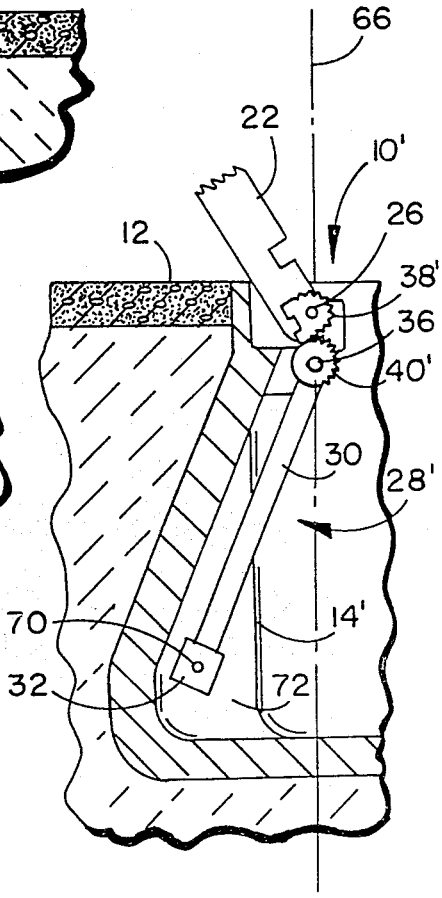
FIG. 5 is a sectional elevational view illustrating an alternative embodiment of a balancing mechanism according to the invention.

FIG. 5 illustrates an alternative embodiment of the invention. In the embodiment of FIG. 5 the pit 10' is equipped with a single counterweight mechanism 28' located below the lid 22 and midway between the opposite longitudinal extremities thereof. A cheek pocket 72 is defined in the center of the wall 14' of the pit 10' to receive the counterweight mechanism 28. The coupling gear sections 38' and 40' have the same pitch diameter, so that the counterweight 32 is moved through an arc equal and a direction opposite to movement of the lid 22. The counterweight 32 is thereby moved in rotation on both sides of the vertical plane 66 passing through the counterweight axis 36.

In both of the counter-rotatable, meshed, motion controlling gear systems of the two embodiments depicted, motion of the counterweight mechanism is constrained to arcuate movement in a fixed ratio relative to the arcuate movement of the lid. In the embodiment of FIG. 5 this ratio is unity, while in the embodiment of FIGS. 1–4 the ratio is at a fraction which is less than one.

The motion controlling gear sections which rigidly link the counterweight mechanisms to move in counter-rotation with the lid can be any conventional type of gears, such as spur gears, bevel gears, helical gears and the like. Alternatively, a conventional mechanical linkage system can be employed in place of the meshed gear arrangements depicted to join the lid and the counterweight mechanism for movement together in counter-rotation.

The invention may be incorporated into a pit for servicing aircraft or other equipment. Such a pit is formed with walls, a floor, and has a heavy lid which is easily removable with the help of counterweights or some other servo assistance according to the invention. The improvement of the invention may be comprised of levers, shafts, gears, mounting means, hydraulic equipment, and/or counterweights which make it possible for one man to open a lid of several hundred pounds. The weight of the lid is balanced to a great extent by counterweights and the lid is mounted rotatably about hinges at the top of one of the walls of the pit.

Undoubtedly, numerous other variations and modifications of the invention will become readily apparent to those familiar with pits and mechanical linkage systems. Accordingly, the scope of the invention should not be construed as limited to the particular embodiments depicted and described, but rather is defined in the claims appended hereto.

I claim:

1. In a prefabricated pit for servicing an aircraft and formed with walls, a floor, and a lid rotatable about hinge means at the top of said walls and about a horizontal lid axis, the improvement comprising rotatable, counterweight means secured for rotation about a horizontal counterweight axis that is located below and parallel to said lid axis, and coupling means for rigidly joining said counterweight means to said lid to move said counterweight means below said lid in counter-rotation relative thereto.

2. A prefabricated pit according to claim 1 wherein said counterweight means is comprised of at least one arm extending radially from said counterweight axis within said pit.

3. A prefabricated pit according to claim 2 further comprising at least one weight which is positionable at different locations along each said arm, and means for releasably securing said weights relative to said arms.

4. A prefabricated pit according to claim 1 in which said counterweight means is longitudinally positioned to balance torsional forces on said lid hinge means produced by the weight of said lid and the weight of said counterweight means.

5. A prefabricated pit according to claim 4 in which said counterweight means comprises a pair of counterweight structures spaced from each other in axial separation along said counterweight axis equidistant from the longitudinal center of said lid axis.

6. A prefabricated pit according to claim 4 in which said counterweight means is mounted below said lid and midway between the opposite longitudinal extremities of said lid.

7. A prefabricated pit according to claim 1 in which said coupling means is comprised of meshed, counter-rotatable gear means.

8. A prefabricated pit according to claim 7 in which said coupling means further comprises a lid gear means locked for movement with said lid meshed with a counterweight gear means locked for rotation with said counterweight means, and the pitch diameter of said lid gear means is smaller than the pitch diameter of said counterweight gear means.

9. A prefabricated pit according to claim 1 in which a wall of said prefabricated pit are formed with a cheek pocket to receive said counterweight means, and said coupling means moves said counterweight means in rotation on both sides of a vertical plane passing through said counterweight axis.

10. Apparatus for assisting rotatable movement of an access lid to a subsurface chamber having at least one wall above which said lid is mounted by hinge means for rotation about a horizontal lid axis comprising: counterweight means mounted on said wall for rotatable movement in an arcuate path relative thereto about an axis parallel to said lid axis, and coupling means rigidly linking said counterweight means to move in counter-rotation with said lid.

11. Apparatus according to claim 10 further characterized in that said coupling means is comprised of a pair of meshed gear mechanisms, one of which rotates with said lid about said lid axis, and the other of which rotates with said counterweight means about said counterweight axis.

12. Apparatus according to claim 10 further characterized in that said coupling means limits movement of said counterweight means between a position located vertically beneath said counterweight axis and a position in a horizontal plane containing said counterweight axis.

13. Apparatus according to claim 10 further characterized in that said coupling means includes motion controlling means which moves said counterweight means in arcuate movement at a fixed ratio relative to the arcuate movement of said lid.

14. Apparatus according to claim 13 further characterized in that said motion controlling means moves said counterweight means at a fraction less than one of the movement of said lid.

15. Apparatus according to claim 13 further characterized in that said motion controlling means moves said counterweight means through an arc equal and a direction opposite to movement of said lid.

16. A balancing mechanism for a subsurface chamber having at least one upright wall at the top of which an access lid is mounted on lid hinge means for rotation about a horizontal lid axis comprising: counterweight means located in said chamber and mounted relative to said wall by counterweight hinge means for rotation about a counterweight axis parallel to said lid axis and coupling means for joining said lid and said counterweight means for movement in counter-rotation together.

17. A balancing mechanism according to claim 16 in which said coupling means is comprised of a counter-rotatable, meshed gear system.

18. A balancing mechanism further comprising means for adjusting the distance of the center of mass of said counterweight means from said counterweight axis.

* * * * *

Disclaimer 4,467,932.—*Robert M. Dabich,* Garden Grove Calif. EASY LIFT PIT LID. Patent dated Aug. 28, 1984. Disclaimer filed Oct. 1, 1985, by the *inventor.*

Hereby enters this discalimer to claims 10, 11, 12, 13, 15, 16, 17 and 18 of said patent.

[*Official Gazette December 10, 1985.*]

REEXAMINATION CERTIFICATE (685th)

United States Patent [19] [11] B1 4,467,932

Dabich [45] Certificate Issued May 19, 1987

[54] EASY LIFT PIT LID

[76] Inventor: Robert M. Dabich, 7212 Patterson Dr., Garden Grove, Calif. 92641

Reexamination Request:
No. 90/001,067, Aug. 18, 1986

Reexamination Certificate for:

| | |
|---|---|
| Patent No.: | **4,467,932** |
| Issued: | **Aug. 28, 1984** |
| Appl. No.: | **538,187** |
| Filed: | **Oct. 3, 1983** |

Disclaimer of claims 10–13,15–18 filed Oct. 1, 1985

[51] Int. Cl.[4] ..... B65D 25/24
[52] U.S. Cl. ..... 220/18; 220/334
[58] Field of Search ..... 220/18, 334, 335; 217/60 R; 49/379; 16/81

[56] References Cited

U.S. PATENT DOCUMENTS

| | | | |
|---|---|---|---|
| 768,869 | 8/1904 | Symons | 49/379 |
| 1,346,787 | 7/1920 | Kryh . | |

*Primary Examiner*—George T. Hall

[57] ABSTRACT

A servo power system is provided for the heavy lid of a pit designed for installation below the surface of an aircraft docking and refueling area. For one embodiment, a counterbalancing system is shown. The lid is mounted for rotation at the top of a pit wall about lid hinges lying along a horizontal axis. A counterweight is secured for rotation about a horizontal counterweight axis which is located below and parallel to the lid axis. Meshed gear sections on the lid and on the counterweight couple the lid and counterweight to move together in counter-rotation relative to each other. The weight of the lid is largely balanced by the weight of the counterweight, thereby facilitating opening and closing of the pit lid.

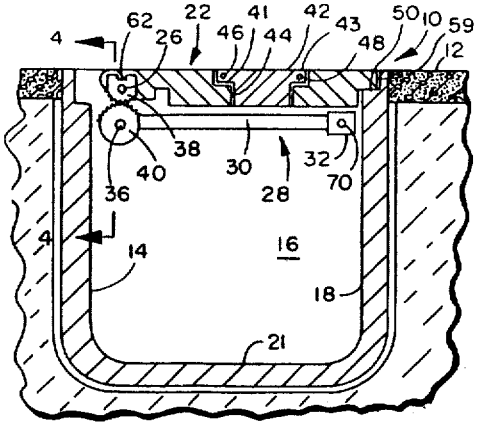

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

ONLY THOSE PARAGRAPHS OF THE SPECIFICATION AFFECTED BY AMENDMENT ARE PRINTED HEREIN.

Column 2, lines 21-25:

The counterweight arms are generally [horizontal] *horizontally* disposed when the lid is closed. The ends of the arms proximate to the lateral edges of the lid are mounted by counterweight hinges, typically by brackets on the pit wall proximate to the lid hinge axis.

Column 2, line 67-Column 3, line 21:

The coupling mechanism controls the motion of both the lid and the counterweights by moving the counterweights in arcuate movement at a fixed [ration] *ratio* relative to the arcuate movement of the lid. It is frequently desirable to open the lid beyond an upright vertical disposition so that it resides in an obtuse angle relative to its closed position. This facilitates maneuvering bulky equipment or tools into the pit, and also facilitates the withdrawal of such materials from the pit. It is not particularly desirable for the counterweights to rotate beyond a position in which the counterweight arms extend vertically downward, however, as this requires the installation of cheek pockets or other recesses to allow passage of the counterweight arms through an obtuse angle. The construction of cheek pockets in a pit can be avoided by employing a motion controlling means in the coupling mechanism which moves the counterweights at a fixed fraction, less than unity, of the movement of the lid. Thus, while the lid is moved through an angle of perhaps 110 degrees in one direction of rotation, the counterweights are moved through an angle of perhaps 90 degrees in an opposite direction of rotation.

Column 4, lines 48-62:

A pair of mounting brackets 58 project inwardly toward the cavity defined *by* the pit 10 and upwardly toward the lid 22 from the wall 14. The mounting brackets 58 are of an L-shaped configuration and are located near the pit walls 16 and 20 at the top of the pit wall 14. The mounting brackets 58 each include an upwardly projecting leg with a horizontal aperture defined therethrough to receive a lid hinge axle 60, illustrated in FIG. 4. The lid hinge axle 60 lies along the lid axis 26 and passes through a downwardly disposed lid 62 at the lateral edges 54 and 56 of the lid 22. The lid axle 60 may be constructed in the form of a bolt which is threadably engaged in corresponding threads in an uppermost horizontal aperture in the interior of each pair of mounting brackets 58, as best depicted in FIG. 4.

AS A RESULT OF REEXAMINATION, IT HAS BEEN DETERMINED THAT:

The patentability of claims 1-9 and 14 is confirmed.

Claims 10-13 and 15-18 were previously disclaimed.

New claims 19-25 are added and determined to be patentable.

*19. In an apparatus for assisting rotatable movement of an access lid that is able to withstand the weight of the tires of an aircraft traveling thereacross to a subsurface chamber for use in servicing aircraft, which chamber is located beneath a surface across which aircraft travel and has at least one wall above which said lid is mounted by hinge means for rotation about a horizontal lid axis, the improvement comprising:*

*counterweight means mounted on said wall for rotatable movement in an arcuate path relative thereto about an axis parallel to said lid axis, and coupling means rigidly linking said counterweight means to move in counter-rotation with said lid.*

*20. Apparatus according to claim 19 further characterized in that said coupling means is comprised of a pair of meshed gear mechanisms, one of which rotates with said lid about said lid axis and the other of which rotates with said counterweight means about said counterweight axis, in which the pitch diameter of said gear mechanism which rotates with said lid is smaller than the pitch diameter of said gear mechanism that rotates with said counterweight means.*

*21. Apparatus according to claim 19 further characterized in that said coupling means limits movement of said counterweight means between a position located vertically beneath said counterweight axis and a position in a horizontal plane containing said counterweight axis, while causing movement of said lid between an open position through an obtuse angle to a closed position in a horizontal plane containing said lid axis.*

*22. Apparatus according to claim 19 in which the moment resulting from said counterweight means is insufficient to open said lid from a closed, horizontal position and is sufficient to allow said lid to be lifted from said closed, horizontal position with a force no greater than twenty-five pounds.*

*23. In a subsurface chamber defined below a surface across which aircraft travel and having at least one upright wall at the top of which an access lid capable of withstanding the weight of the tires of an aircraft traveling thereacross is mounted on lid hinge means for rotation about a horizontal lid axis, the improvement comprising a balancing mechanism including:*

*counterweight means located in said chamber and mounted relative to said wall by counterweight hinge means for rotation about a counterweight axis parallel to said lid axis and exerting a moment opposed to and less than the moment resulting from the weight of said lid, and coupling means for joining said lid and said counterweight means for movement in counter-rotation together.*

*24. A balancing mechanism according to claim 23 wherein said coupling means is comprised of a lid gear means locked for movement with said lid and a counterweight gear means locked for rotation with said counterweight means and meshed with said lid gear means, wherein the pitch diameter of said lid gear means is smaller than the pitch diameter of said counterweight gear means.*

*25. A balancing mechanism according to claim 24 in which said counterweight means exerts a moment opposing the moment resulting from the weight of said lid such that a force of no greater than 25 pound is required to lift said lid from a closed, horizontal position and such that said lid cannot open by itself.*

* * * * *